169-46

2/5/85 OR 4,497,374

United States Patent [19]

Millar

[11] Patent Number: 4,497,374

[45] Date of Patent: Feb. 5, 1985

[54] CANDLE SNUFFER AND METHOD

[76] Inventor: William G. Millar, 124 Arlington Rd., Utica, N.Y. 13501

[21] Appl. No.: 497,361

[22] Filed: May 23, 1983

[51] Int. Cl.[3] ..... A62C 3/00

[52] U.S. Cl. ..... 169/46; 169/49; 431/144

[58] Field of Search ..... 30/322, 131; 431/144, 431/35, 288; D29/2; D7/137; D8/16, 48; 428/543

[56] References Cited

U.S. PATENT DOCUMENTS

| | | | |
|---|---|---|---|
| 164,956 | 6/1875 | Anderson | 30/322 |
| 767,892 | 8/1904 | Isakson | 431/35 |
| 1,056,614 | 3/1913 | Weikert | 30/322 X |
| 2,213,203 | 9/1940 | Buchman | 431/35 |
| 3,775,037 | 11/1973 | Sande | 431/144 |
| 3,985,492 | 10/1976 | Nunemaker | 431/144 |

OTHER PUBLICATIONS

The Title Page, the Verso of the Title Page and pp. 188T and 190T of "Enamel, Steel and Sheet Metal Cooking and Sanitary Wares", Copy in Metal Files of the Design Classes Library.

*Primary Examiner*—Henry F. Epstein
*Attorney, Agent, or Firm*—Charles S. McGuire

[57] ABSTRACT

A candle snuffer is disclosed in the form of a unitary member having a pair of generally parallel, elongated tines. The tines are spaced by a distance slightly larger than the thickness of a normal candle wick and the flame is extinguished by placing the base of the wick between the tines and lifting the snuffer upwardly. As the tines pass the end of the wick, the flame is immediately extinguished.

1 Claim, 3 Drawing Figures

CANDLE SNUFFER AND METHOD

BACKGROUND OF THE INVENTION

The present invention relates to candle snuffers and, more particularly, to a novel implement for and method of extinguishing the flame of a burning candle wick.

All prior candle snuffers of which I am aware involve means for covering the end of the wick to smother the flame.

It is a principal object of the present invention to provide an article of manufacture for extinguishing a candle flame without covering the end of the wick.

Another object is to provide a novel method of extinguishing a candle flame employing an implement in the nature of a two-tined fork, Other objects will in part be obvious and will in part appear hereinafter.

SUMMARY OF THE INVENTION

In accordance with the foregoing objects, the invention contemplates a candle snuffer in the form of a unitary implement comprising a handle with a pair of elongated tines extending therefrom. The tines are spaced, at least in predetermined portions thereof, by a distance or slightly greater than, the thickness of a standard candle wick. Preferably, the tines taper outwardly to a somewhat wider space at their free ends to facilitate placement of a candle wick therebetween.

The implement is utilized by being advanced in a forward direction while being held by the handle to cause the tines to straddle the base of the wick of a burning candle. When the implement has been advanced to the point that the wick base is at or near the closed ends of the tines, or at least between the more closely spaced portions thereof, it is lifted upwardly, over the end of the wick, which serves immediately and efficiently to extinguish the flame.

DETAILED DESCRIPTION

Figure 3:
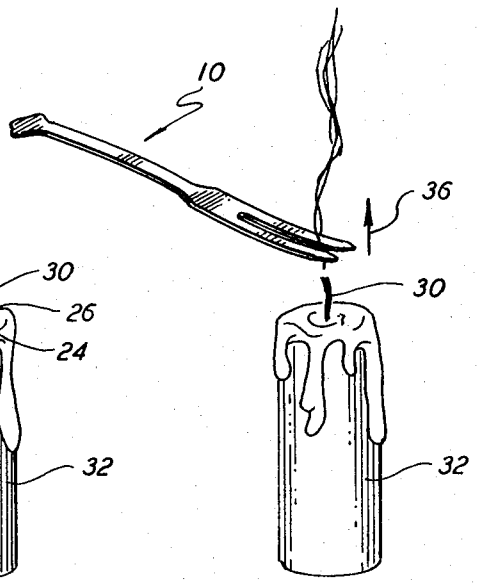
FIG. 3 is a perspective view showing movement of the implement to extinguish the flame.

Referring now to the drawing, candle snuffer 10 is formed as a unitary implement having handle portion 12 with elongated tines 14 and 16 of equal length extending therefrom generally parallel to one another. The spacing between tines 14 and 16 where they are joined at 18 is approximately 1/16th". The tines are preferably tapered outwardly in portions 20 and 22 thereof to a spacing at free ends 24 and 26 of about 3/16".

Figure 2:
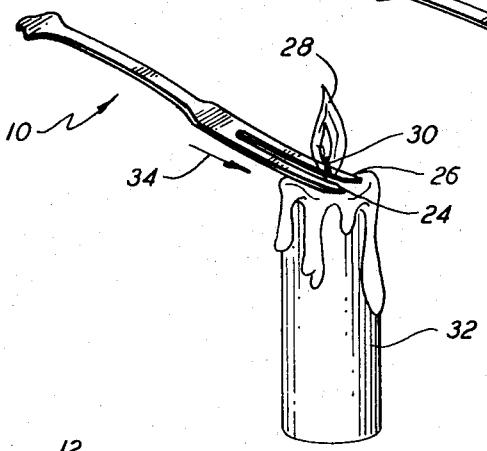
FIG. 2 is a perspective view illustrating the snuffer as it is moved to engage the wick of a burning candle.
Figure 1:
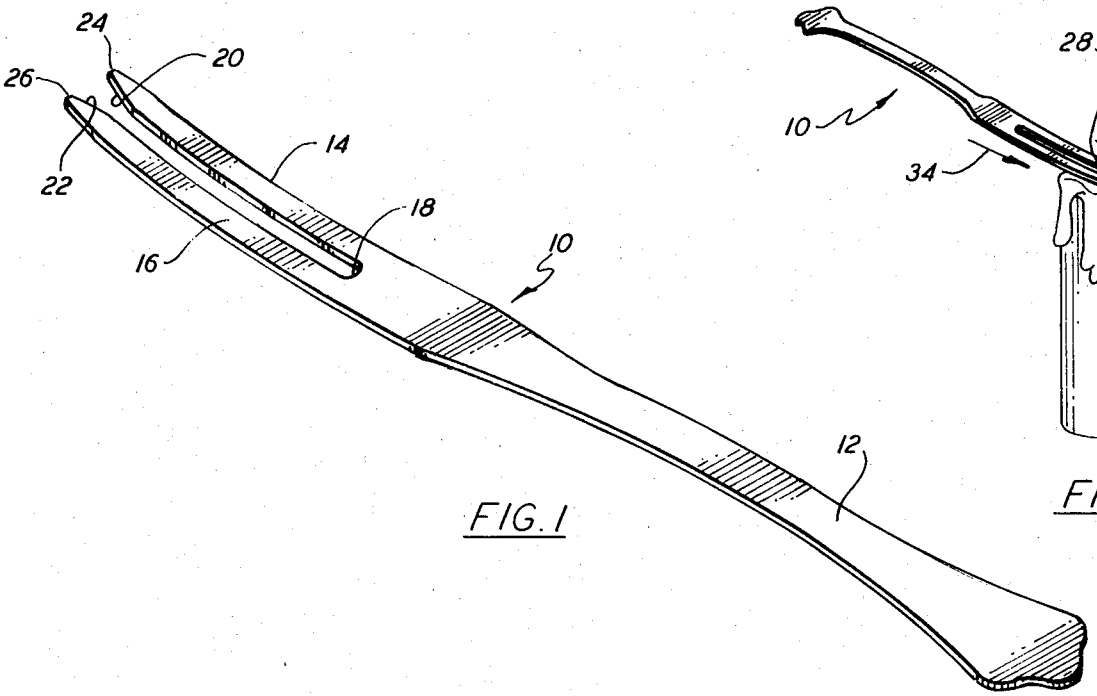
FIG. 1 is a plan view of the canlde snuffer of the invention.

FIGS. 2 and 3 illustrate the manner of manipulation of snuffer 10 to extinguish the flame 28 on wick 30 of candle 32. While grasped by handle 12, snuffer 10 is moved forwardly, as indicated by arrow 34 in FIG. 2, to place tines 14 and 16 on opposite sides of wick 30 near its base, or at any point below flame 30. The wider spacing at free ends 24 and 26, and tapered portions 20 and 22, facilitates movement of the snuffer to a position where wick 30 is between portions of tines 14 and 16 which are spaced by a distance slightly larger than the thickness of the wick, normally about 1/16". Such portions may extend essentially from closed end 18 to tapered portions 20 and 22. When snuffer 10 has been moved to such a position it is lifted upwardly, as indicated by arrow 36 in FIG. 3, over the end of wick 30. Such movement serves to cut off momentarily the supply of oxygen to the flame, thereby immediately extinguishing it in a simple, yet novel and unique manner.

What is claimed is:

1. A method of extinguishing the flame of a candle having a wick of predetermined thickness with a candle snuffer having a handle portion and a pair of elongated tines extending therefrom in spaced relation, the space between at least predetermined portions of said tines being not substantially greater than said predetermined wick thickness, said method comprising the steps of:

(a) moving said candle snuffer in a generally forward direction along the axis of said elongated tines to place a portion of said candle wick between the flame and the candle body between said predetermined portions of said tines; and (b) moving said candle snuffer in a generally upward direction to draw said predetermined portions of said tines over the end of said wick, thereby extinguishing said flame.

* * * * *